US005445793A

United States Patent [19]

Tuckner et al.

[11] Patent Number: 5,445,793

[45] Date of Patent: Aug. 29, 1995

[54] METHOD AND APPARATUS FOR STERILIZING CARTONS AND BREAKING CARTON SCORE LINES

[75] Inventors: Ronald Tuckner, White Bear Lake, Minn.; David Perselis, Twin Lakes, Wis.

[73] Assignee: Tetra Laval Holdings & Finance S.A., Pully, Switzerland

[21] Appl. No.: 262,929

[22] Filed: Jun. 21, 1994

Related U.S. Application Data

[62] Division of Ser. No. 973,300, Nov. 9, 1992, Pat. No. 5,350,568.

[51] Int. Cl.[6] ..... A61L 2/20; B65B 55/04

[52] U.S. Cl. ..... 422/28; 422/300; 422/302; 422/304; 53/426; 53/370.2; 426/399

[58] Field of Search ..... 422/28, 304, 302, 300, 422/24–27; 426/399; 53/167, 370.2, 372.2, 426, 565, 466–467

[56] References Cited

U.S. PATENT DOCUMENTS

| | | | |
|---|---|---|---|
| 3,525,194 | 8/1970 | Moors et al. | 53/467 |
| 3,566,575 | 3/1971 | Lisiecki | 53/467 |
| 3,579,958 | 5/1971 | Hentges et al. | 53/565 |
| 3,716,083 | 2/1973 | Tuma et al. | 141/90 |
| 3,785,113 | 1/1974 | Mårtensson et al. | 53/565 |
| 3,970,426 | 7/1976 | Stark et al. | 422/24 |
| 3,994,686 | 11/1976 | Rauser et al. | 53/167 |
| 4,448,008 | 5/1984 | Pankratz et al. | 53/272 |
| 4,448,013 | 5/1984 | Nakajima | 53/565 |
| 4,566,251 | 1/1986 | Spisak et al. | 53/426 |
| 4,589,862 | 5/1986 | Murrah | 53/565 |
| 4,896,478 | 1/1990 | Reiter | 53/426 |

*Primary Examiner*—Robert J. Warden
*Assistant Examiner*—Hien Tran
*Attorney, Agent, or Firm*—Burns, Doane, Swecker & Mathis

[57] ABSTRACT

An apparatus for sterilizing and breaking score lines on cartons prior to filling includes a spraying assembly for spraying sterilizing solution into the interior of the carton and a score line breaking assembly that breaks the score lines on the upstanding walls of the carton. The spraying assembly and the score line breaking assembly are located at the same station within a filling machine so that both operations can be performed simultaneously. The spray assembly includes a movably mounted spray head that is provided with a spray nozzle. The score line breaking assembly includes a breaker member that is operatively connected to a drive assembly for driving the breaker member into contacting relation with the upper portion of the upstanding walls of a carton in order to urge the upstanding walls of the carton inwardly and thereby break the score lines on the carton walls. A device can be included to urge the breaker member and the spray head towards one another so that downward movement of the breaker member towards the carton results in downward movement of the spray head into the interior of the carton.

12 Claims, 5 Drawing Sheets

Fig. 6(a)
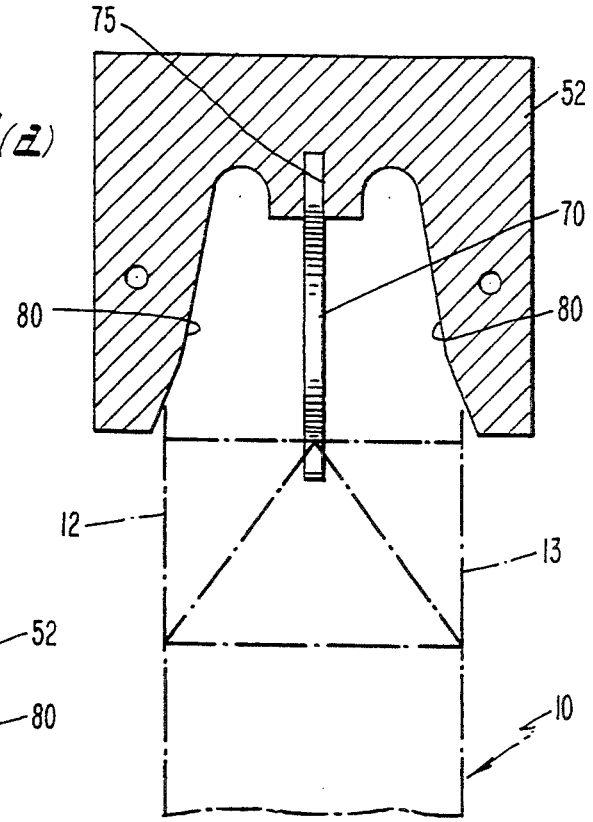
Fig. 6(b)
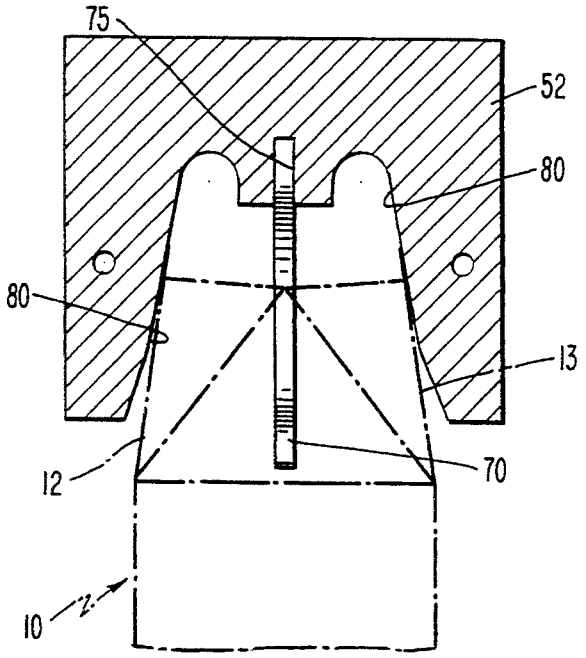
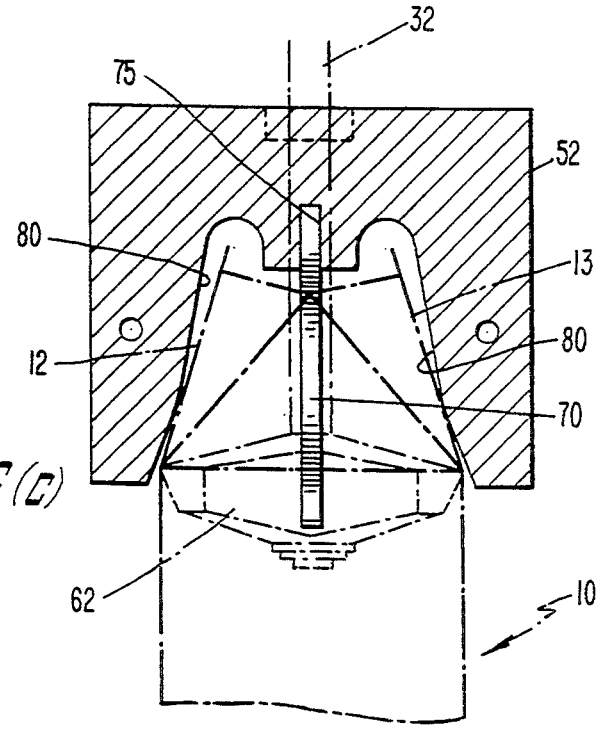
Fig. 6(c)

METHOD AND APPARATUS FOR STERILIZING CARTONS AND BREAKING CARTON SCORE LINES

This application is a divisional of application Ser. No. 07/973,300, filed Nov. 9, 1992, now U.S. Pat. No. 5,350,568.

FIELD OF THE INVENTION

The present invention relates to a method and apparatus for sterilizing cartons and breaking carton score lines prior to filling. More particularly, the present invention pertains to a method and apparatus that minimizes the amount of space necessary to sterilize cartons and break the carton score lines before the cartons are filled.

BACKGROUND OF THE INVENTION

Paperboard cartons are commonly used for packaging various types of food products such as milk and juice. Such food products are conventionally packaged in gable top cartons which are preformed with a closed bottom and upstanding walls. Typically, the cartons are placed on a conveyor which intermittently advances the cartons through a filling machine. Before the cartons are filled, however, it may be desirable to subject the cartons to various operations. For example, to increase the shelf life of food products, the interior of the carton can be subjected to a sterilizing operation. Sterilization of the carton can be effected by spraying a hydrogen peroxide solution into the interior of the carton.

After the cartons have been filled, they are advanced to a station in which the top portion of each carton is closed and sealed to result in a filled gable top carton. The carton is usually provided with several score lines which define the fold lines about which the top portion of the walls bend so as to form the gable top carton. To facilitate the proper folding (i.e., closing) of the canon walls, it is oftentimes desirable to prebreak the score lines on the carton (i.e., break the score lines before they are folded and sealed at the closing and sealing station). In that way, once the cartons reach the stage in which the upstanding carton walls are folded and sealed, the carton is much less susceptible to being improperly folded and sealed.

It can be readily appreciated, however, that if the aforementioned sterilizing and score line breaking operations are positioned at successive stations within the filling machine so as to require that the carton be advanced from one station in which the carton score lines are broken to another station in which the carton is sterilized, additional space will be required within the filling machine. In the case of existing machines, space constraints may not allow both operations to be carried out at successive stations. Thus, if limited to positioning the two operations at successive stations, it may not be possible to perform both operations in the filling machine.

OBJECTS AND SUMMARY OF THE INVENTION

In view of the foregoing, it is an object of the present invention to provide a method and apparatus for sterilizing cartons and breaking the carton score lines before the cartons are filled with food product.

It is another object of the present invention to provide a method and apparatus that require a minimum amount of space in order to sterilize the cartons and break the carton score lines on the upstanding walls.

It is a further object of the present invention to provide a method and apparatus that allows the sterilization of the cartons and the breaking of the carton score lines to be carried out simultaneously at a single station.

The foregoing objects and advantages, as well as others, are accomplished in accordance with a preferred embodiment of the apparatus of the present invention which includes a conveying arrangement for intermittently advancing a carton through several successively arranged stations, a spraying arrangement located at one of the stations for spraying hydrogen peroxide solution into the interior of a carton in order to sterilize the carton interior, and a carton score line breaking arrangement which is located at the same station as the spraying arrangement for breaking carton score lines while the carton is being sprayed with the hydrogen peroxide solution.

In accordance with a preferred embodiment of the apparatus according to the present invention, the spraying arrangement includes a spray head that is provided with a spray nozzle through which the hydrogen peroxide is delivered for being sprayed into the interior of a carton. The score line breaking arrangement can include an anvil that is carried on the spray head for being positioned in the interior of a carton adjacent to a score line, a movably mounted breaker member for breaking the carton score lines, and a drive arrangement that is operatively connected to the breaker member for moving the breaker member from one position in which the breaker member is spaced from the upper portion of the carton walls to another position in which the breaker member is in contact with the upper portion of the carton walls to urge the upper portion of the carton walls inwardly and thereby break the carton score lines. The breaker member is preferably positioned in surrounding relation to the spray head and is connected to the spray head so that movement of the breaker member towards the carton causes the spray head to be positioned within the interior of the carton. In that way, the sterilization of the canon interior and the breaking of the carton score lines can be effected simultaneously.

Another aspect of the present invention involves a method of sterilizing cartons and breaking carton score lines. The method includes the steps of advancing a carton to a sterilizing and score line breaking station, spraying sterilizing solution into the interior of the carton while the canon is located at the sterilizing and score line breaking station, and urging an upper portion of the carton walls inwardly to break the carton score lines while the carton is located at the sterilizing and score line breaking station.

In the preferred embodiment of the method of the present invention, the upper portion of the carton walls is urged inwardly by moving a breaker member in a downward direction from one position in which the breaker member is spaced from the carton wails to another position in which the breaker member is in contact with the upper portion of the carton wails. The step of spraying sterilizing solution into the interior of the carton can include moving a spraying head that is provided with a spray nozzle in a downward direction from a first position in which the spray head is positioned exteriorly of the carton interior to a second position in which the spray head is positioned in the carton interior. Moreover, the sterilizing step and the score line breaking operation are carried out simultaneously.

BRIEF DESCRIPTION OF THE DRAWING FIGURES

The features of the preferred embodiment of the present invention will become more apparent from the description that follows considered in conjunction with the accompanying drawing figures in which:

FIG. 3(*b*) is a side elevational view of the sterilization and score line breaking system of the present invention in a second position;

FIG. 3(*c*) is a side elevational view of the sterilization and score line breaking system of the present invention in a third position;

FIG. 6(*a*) is a cross-sectional side view of the breaker member as seen in the direction of section line 6—6 in FIG. 4, wherein the breaker member is positioned just prior to contacting the top portion of the canon walls;

Figure 4:
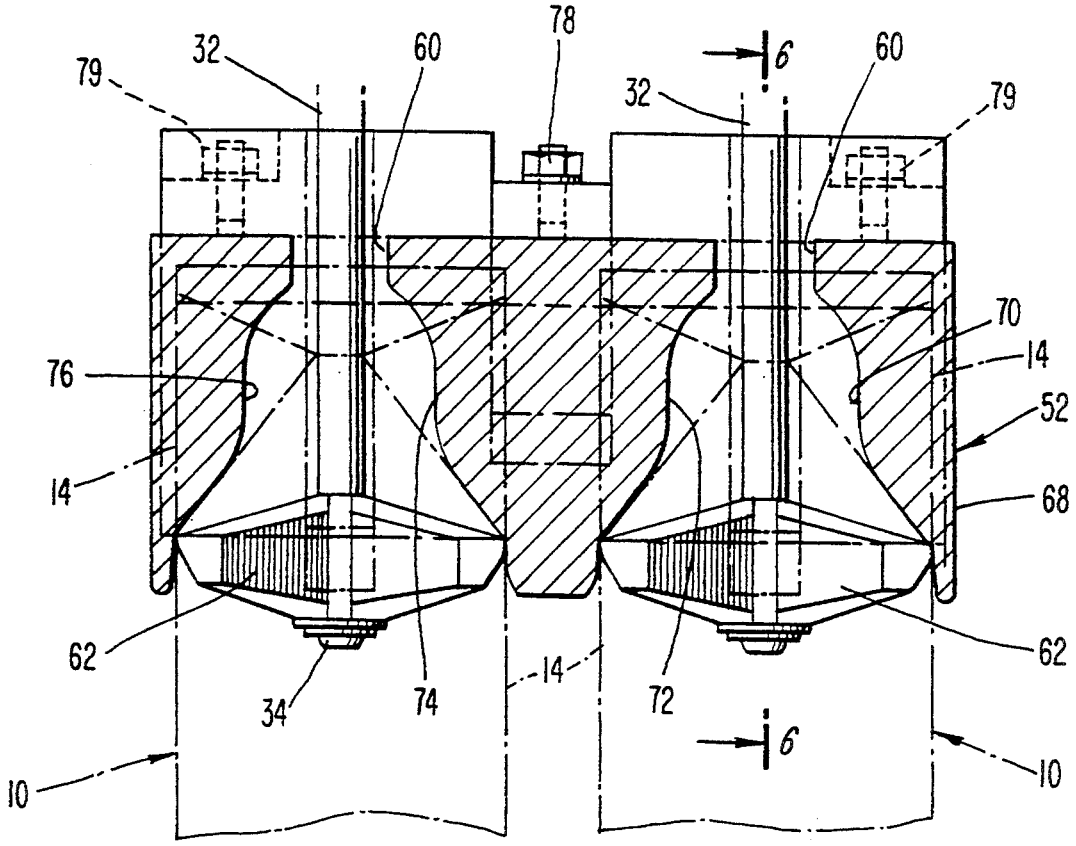
FIG. 4 is cross-sectional front view of the breaker member and the anvil that are employed in the score line breaking assembly of the present invention.
Figure 7:
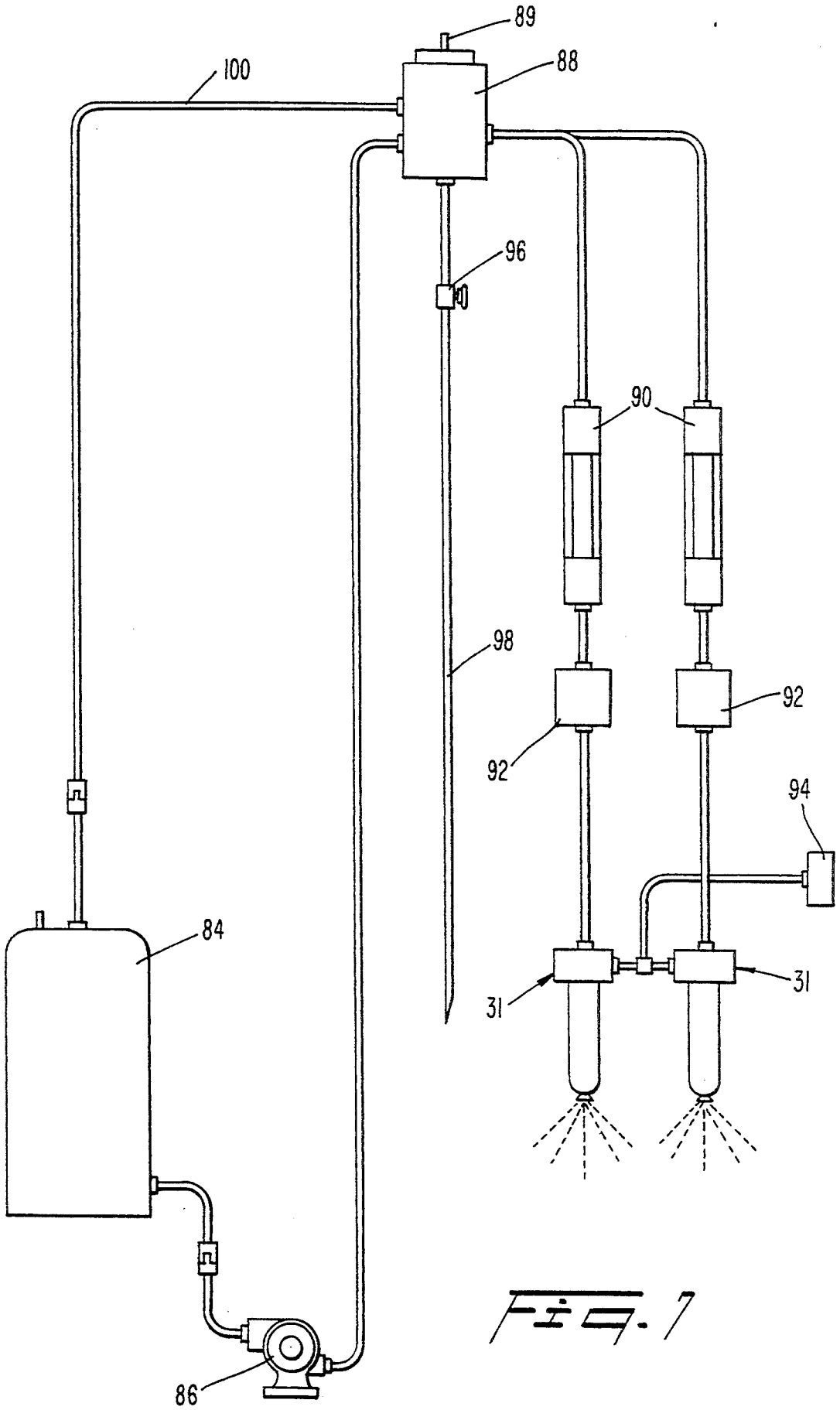

FIG. 6(*b*) is a cross-sectional side view of the breaker member as seen in the direction of section line 6—6 in FIG. 4, wherein the breaker member is in contact with the top portion of the carton FIG. 6(*c*) is a cross-sectional side view of the breaker member as seen in the direction of section line 6—6 in FIG. 4, wherein the top portion of the carton walls are surrounded by the breaker member; and FIG. 7 is a schematic illustration of a gravity fed sterilizing solution supply system usable in conjunction with the sterilizing assembly of the present invention.

DETAILED DESCRIPTION OF THE PREFERRED EMBODIMENT

The apparatus and method of the present invention can be used in a conventional automatic filling machine, such as the type disclosed in U.S. Pat. No. 4,448,008, that is designed to fill preformed cartons with liquid food products such as milk or juice. In operation, those conventional automatic filling machines are supplied with preformed blanks. The machine opens the preformed blanks to form a tube, seals the bottom of the tube to form a carton with an open top and upstanding walls, and places the carton on a conveyor which intermittently advances the carton through a plurality of successively arranged stations. As the carton advances through the machine, food product is dispensed into the carton and thereafter, the carton top is closed and sealed. The filled and closed carton is then conveyed out of the machine.

Figure 1:
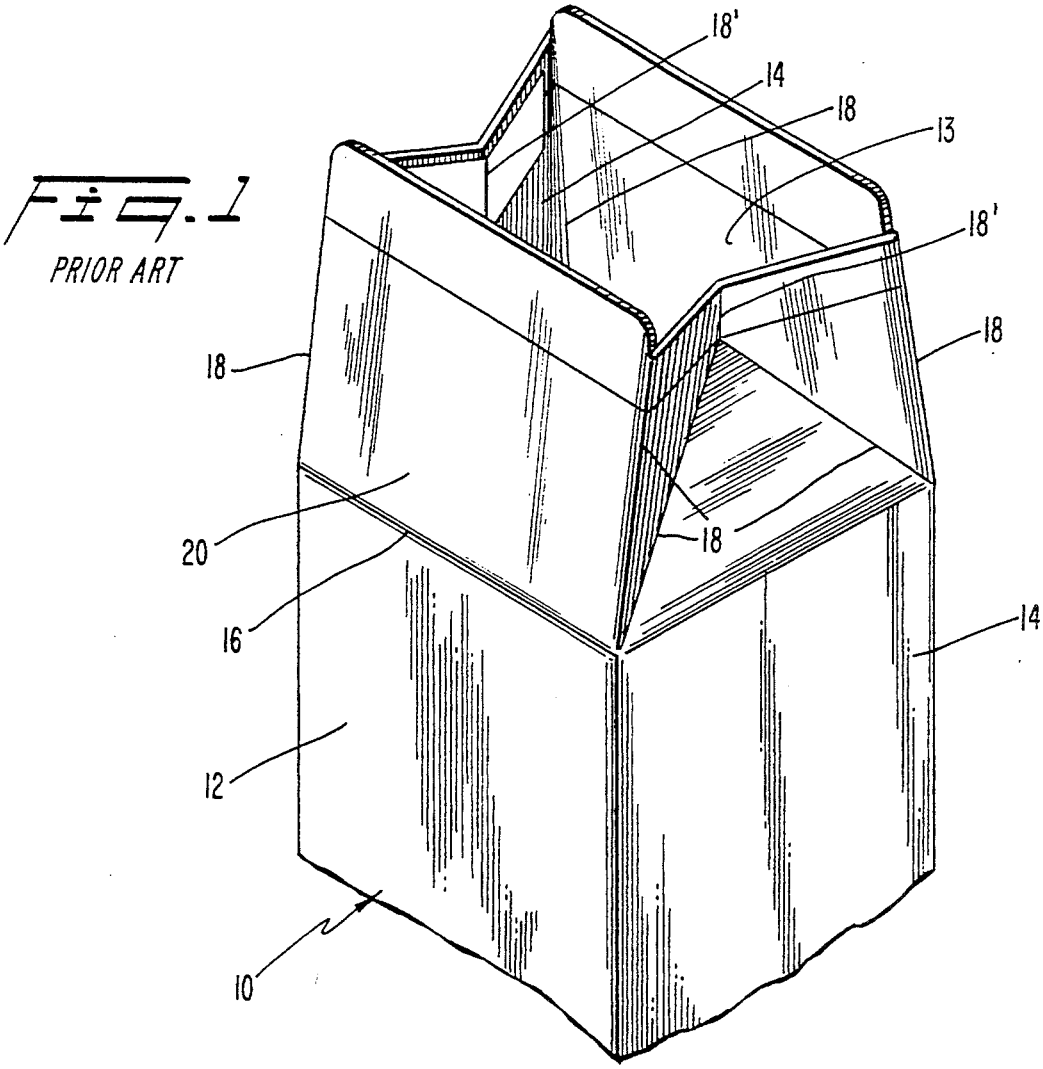
FIG. 1 PRIOR ART
FIG. 1 is a perspective view of a top portion of a gable top carton.

The type of carton to which the apparatus and process according to the present invention are particularly useful is a gable top carton such as is illustrated in FIG. 1. The gable top carton 10 comprises a preformed bottom (not shown) and a plurality of upstanding walls that include a front wall 12, an oppositely positioned back wall 13, and two oppositely positioned side walls 14. The gable top carton 10 also includes a score line 16 (alternatively referred to as a crease line or a fold line) that extends around the circumference of the upstanding walls 12, 13, 14, and several additional score lines 18, 18' (crease lines or fold lines) on the upper portion of the side walls 14. The score lines 16, 18 allow the top portion 20 of the carton to be appropriately folded so as to result in a gable top carton. More particularly, the score line 16 allows the upper portion of the side walls 14, the front wall 12 and the back wall 13 to be folded inwardly, while the score lines 18, 18' allow the upper portion of the side walls 14 to also be pinched inwardly to form several generally triangular panels.

Figure 2:
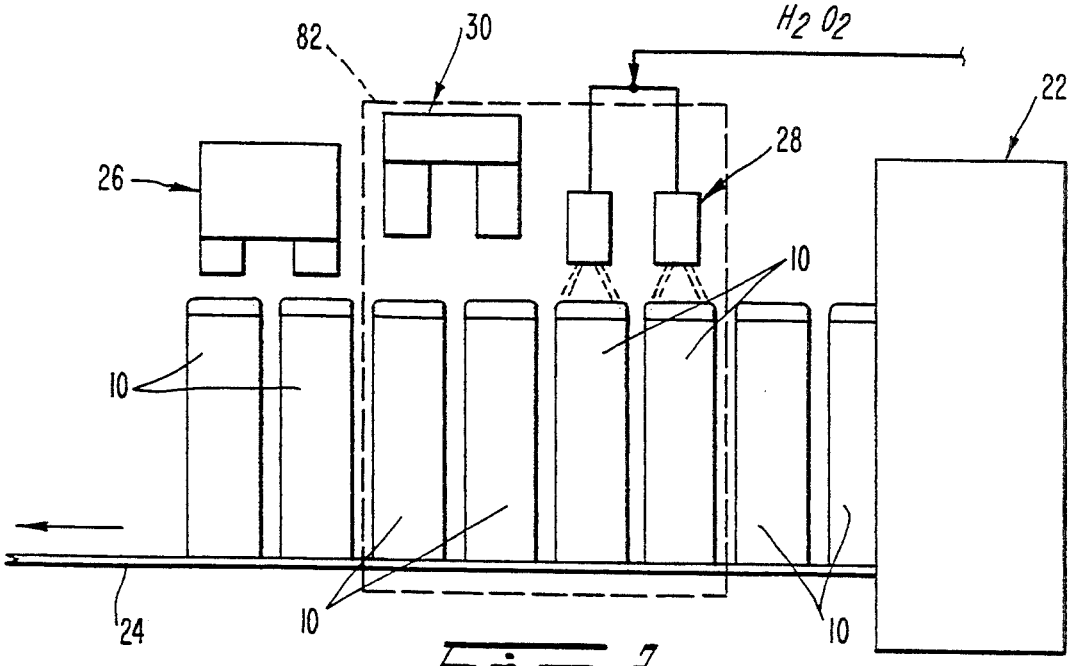
FIG. 2 PRIOR ART
FIG. 2 is a schematic view of a carton filling apparatus in which the sterilization and score line breaking system of the present invention can be employed.

Referring to FIG. 2, a conventional automatic filling machine is generally depicted. A carton formation apparatus 22 receives preformed blanks, opens the blanks to form tubes, seals the bottom end of each of the tubes to form cartons 10 having an open top and upstanding walls, and then places the cartons 10 in sequence on a conveyor 24. In accordance with conventional practice, the conveyor 24 intermittently advances two stations at a time, thereby allowing two cartons 10 to be processed simultaneously at the various stations. Of course, the system according to the present invention could be adapted to machines in which the cartons advance one station at a time or more than two stations at a time.

It is to be understood that the cartons 10 which exit the carton formation apparatus 22 are slightly different from the carton 10 illustrated in FIG. 1. For illustrative purposes, the upper portion of the carton walls 12, 13, 14 are depicted in FIG. 1 as being folded inwardly slightly, but in practice the cartons 10 exiting the carton formation apparatus 22 possess straight, unfolded upstanding walls 12, 13, 14.

The filling stations 26 are also depicted in FIG. 2. At each of the filling stations 26, food product is dispensed into the open top of the cartons 10 by conventional dispensing equipment. Two cartons 10 are filed simultaneously and are then advanced to the closing and sealing station (not shown) where the top portion of each carton is closed and sealed to form a filled gable top carton.

Before reaching the filling stations 26, each of the open top cartons can also pass through a sterilizing station 28 in order to increase the shelf-fife of the food product by sterilizing the carton. In the sterilizing station 28, each of the cartons 10 is sterilized through the application of a sterilizing solution. Thereafter, the cartons 10 can be advanced to another station 30 for removing excess sterilizing solution on the interior of the cartons 10 before the cartons are filled with food product. Such a drying step may be necessary if the parts per million amount of hydrogen peroxide solution exceeds the level established by the Food and Drug Administration.

The carton sterilization and score line breaking system of the present invention follows the carton formation apparatus 22.

Figures 3A, 3B, 3C:
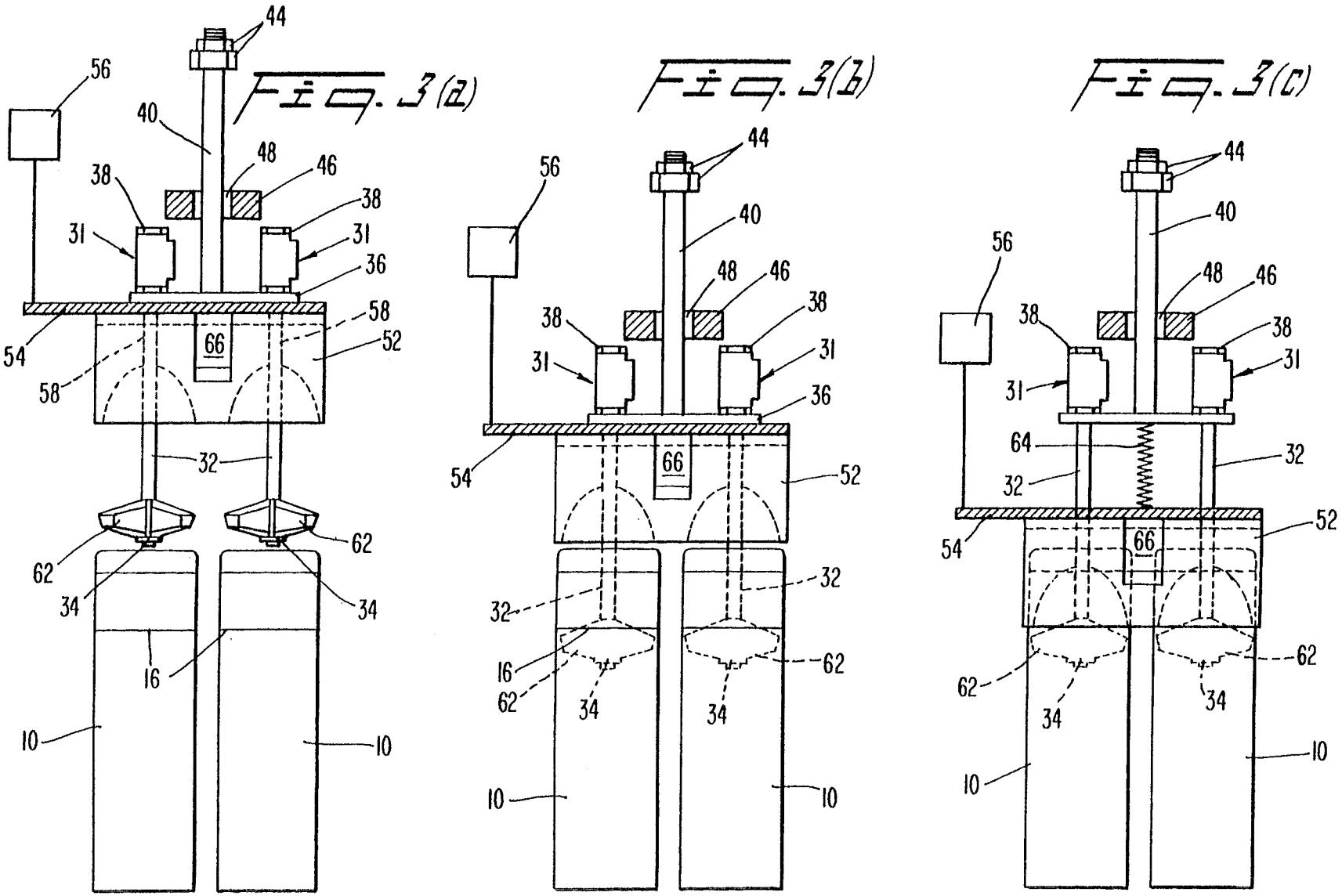
FIG. 3(*a*) is a side elevational view of the sterilization and score line breaking system of the present invention in a first position.

Turning to FIG. 3(*a*), the carton sterilizing and score line breaking system of the present invention is outfitted with a sterilizing assembly and a score line breaking assembly. The sterilizing assembly includes two side-by-side spraying assemblies 31. Each of the spraying assemblies 31 includes a spray head 32 that is provided with a spray nozzle 34 at its one end. As will be discussed in more detail below, the spraying assemblies 31 are adapted to be moved in the vertical direction toward and away from the cartons 10. Each of the spraying assemblies 31 is appropriately mounted on a mounting plate 36 so that the spraying assemblies 31 and the mounting plate 36 move together as a unit. As will also be described in more detail below, a sterilizing solution such as a hydrogen peroxide solution is supplied to the upper end 38 of each of the spray heads 32. The sterilizing solution flows through the spray heads 32 and is then discharged through the spray nozzle 34 into the interior of the underlying carton 10.

A shaft 40 is fixedly connected to the mounting plate 36 and extends upwardly therefrom. The end 42 of the shaft that is remote from the mounting plate 36 is threaded and receives two adjustable nuts 44. Fixedly connected to the frame of the machine (not shown) is a stopper 46 that surrounds the shaft 40. The shaft 40 passes freely through a through hole 48 provided in the fixed stopper 46. As will become more apparent from the description below, the position of the nuts 44 on the threaded end of the shaft 40 can be appropriately adjusted so that, in conjunction with the fixed stopper 46, the stop position of the spraying assemblies 31 can be changed.

As further illustrated in FIG. 3(*a*), a score line breaking assembly 50 is provided for breaking the score lines 16, 18, 18' (see FIG. 1) on the cartons 10. The score line breaking assembly 50 includes a breaker member 52 that is connected to a drive arm 54 in any suitable manner so that the drive arm 54 and the breaker member 52 move together as a unit. The drive arm 54 is connected to a drive arrangement 56 which is generally depicted in FIG. 3(*a*). The drive arrangement 56 can take the form of any suitable power source for moving the drive arm 54 in a vertical direction towards and away from the cartons 10. For instance, the drive arrangement 56 can be a motor that is suitably connected to the drive arm 54 by suitable linkages and/or gears. Alternatively, the drive arrangement 56 can take the form of an air cylinder whose power output is appropriately connected to the drive arm 54 to effect the required vertical movement towards and away from the cartons 10.

As can be readily seen from FIG. 3(*a*), the breaker member 52 is positioned in surrounding relation with respect to the spray heads 32. The spray heads 32 extend freely through respective holes 58 provided in the breaker member 52. As will be described in more detail below, the breaker member 52 is able to move relative to the spraying assemblies 31 along the length of the spray heads 32. If desired, suitable bearings 60 (see FIG. 4) can be provided between the spray heads 32 and the breaker member 52.

The score line breaking assembly 50 further includes an anvil 62 that is carried on each of the spray heads 32 adjacent to the spray nozzles 34. The anvils 62 are preferably fixed relative to the spray heads 32. The anvils 62 can be configured so that the top and bottom surfaces taper axially away from one another towards the spray head 32. Preferably, the anvils 62 are X-shaped as seen from above or below (See FIG. 5) and the dimensions across each anvil (i.e., the width) corresponds to the distance between oppositely positioned walls of the carton. By way of example, the width of the anvil 62 can be approximately 70 mm. As will be described in more detail below, during operation of the system, the anvils 62 are moved to a position in which they are located on the interior of respective cartons 10.

A device is also provided to urge the drive arm 54 and the mounting plate 36 towards one another for purposes that will become apparent from the description below. That urging device can take the form of a tension spring 64 (see FIG. 3(*c*)) that is connected to the mounting plate 36 and the drive arm 54. Of course, other types of devices for achieving the same function could aim be employed. For example, an air cylinder could be interposed between the mounting plate 36 and the drive arm 54. Such an air cylinder could be located within a recessed area 66 (see FIG. 3(*a*)) provided on the outer front side of the breaker member 52.

With reference to FIG. 4, some of the details of the breaker member 52 can be seen. The breaker member 52 includes a breaker block 68 on which are mounted several pinch bars 70, 72, 74, 76. As can be best seen in FIGS. 6(*a*) and 6(*b*), the pinch bars 70, 72, 74, 76 are relatively thin members. Two of the pinch bars 70, 72 are oppositely mounted in facing relation to each other. Similarly, the other two pinch bars 74, 76 are oppositely mounted in facing relation to each other.

The pinch bars 70, 72 forming one pair are adapted to contact the upper portion of the oppositely positioned side walls 14 of one gable top carton 10 while the two pinch bars 74, 76 forming the other pair contact the upper portion of the oppositely positioned side wails 14 of another gable top carton 10. The two inner pinch bars 72, 74 can constitute a single unitary member that is mounted within the breaker block 68 by way of an appropriate securing means such as a screw 78. The two outer pinch bars 70, 76 are separate from one another and secured to the breaker block 68 by suitable means such as screws 79. The pinch bars 70, 72, 74, 76 can be mounted in a groove 75 (see FIGS. 5, 6(*a*) and 6(*b*)) provided in the breaker block 68.

As can be readily seen from FIG. 4, the inner surfaces of each of the pinch bars 70, 72, 74, 76 are contoured to provide an inwardly directed surface at the bottom thereof that gradually merges into a generally vertically oriented surface. The generally vertically oriented surface then curves inwardly again near the upper portion of the pinch bar. The contoured nature of the inwardly facing surfaces on the pinch bars 70, 72, 74, 76 is quite useful in ensuring that the side walls 14 are properly folded so as to break the carton score lines 16, 18, 18'. The relatively thin nature of the pinch bars 70, 72, 74, 76 is advantageous in helping to ensure that the pinch bars contact the upper portion of the carton side walls 14 at the vertically oriented score lines 18'. That also helps facilitate proper inward folding of the upper portion of the side walls 14.

As can be seen in FIGS. 6(*a*), 6(*b*) and 6(*c*), the breaker block 68 is recessed to define an inner surface. The inner surface of the breaker block 68 is provided with oppositely positioned contacting surfaces 80 which face in a direction that is oriented at approximately ninety degrees with respect to the direction in which the contoured surfaces of the pinch bars 70, 72, 74, 76 face. The contacting surfaces 80 of the breaker block 68 are adapted to contact the front wall 12 and the back wall 13 of respective cartons.

As can be seen from a comparison of FIG. 4 with FIGS. 6(*a*), 6(*b*) and 6(*c*), the contour of the contacting surfaces 80 is somewhat different from the contour of the pinch bars 70, 72, 74, 76. At the bottom open end of the breaker block 68, the contacting surfaces 80 are inclined inwardly to a lesser extent than the initial inward inclination of the pinch bars 70, 72, 74, 76. After the initial inclination, the contacting surfaces 80 are still inclined inwardly somewhat but to a lesser extent than the initial inward inclination.

Figure 5:
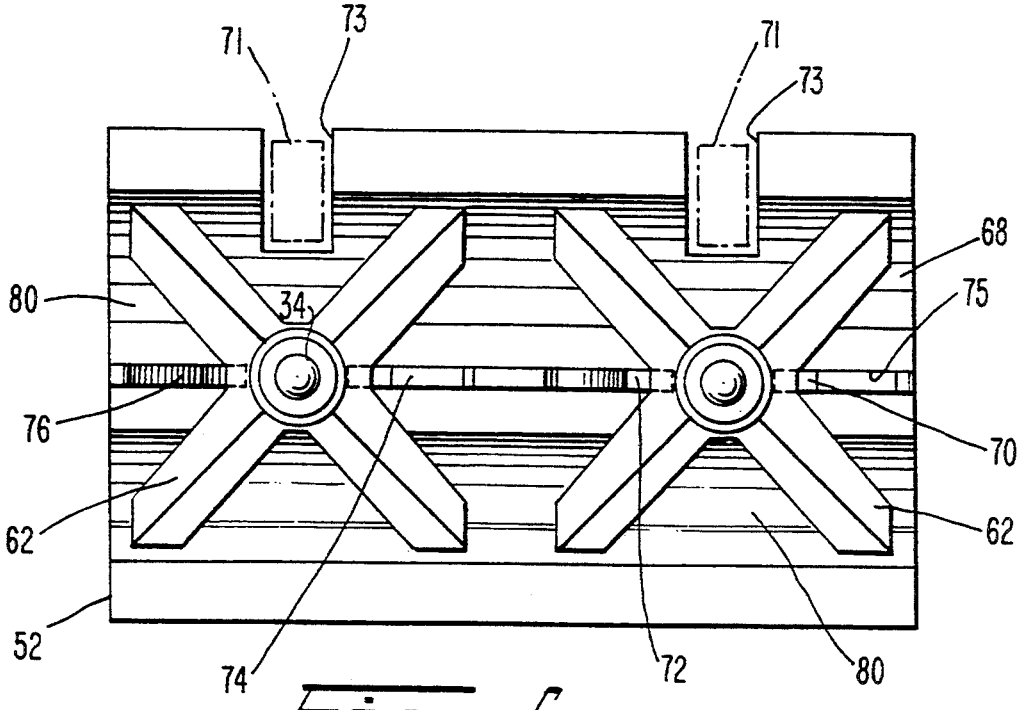
FIG. 5 is a bottom view of the breaker member and anvil illustrated in FIG. 4.

FIG. 5 is a bottom view of the breaker block 68 as seen in FIG. 4 and illustrates the anvils 62 as they are positioned with respect to the breaker block 68. To simplify the FIG. 5 illustration, the pinch bars 70, 72, 74, 76 are not illustrated. It is to be noted that when the anvils 62 are positioned within the respective cartons 10 during use, the arms of the X-shaped anvils 62 are directed at the comers of the respective cartons 10.

Having generally described the features of the sterilizing and carton score line breaking system of the present invention, the operation of the system will now be described with reference to FIGS. 3(*a*), 3(*b*) and 3(*c*). Initially, the spray assemblies 31 and the score line breaking assembly 50 are positioned in the manner illustrated in FIG. 3(*a*). The conveyor 24 (see FIG. 1) advances two cartons 10 to a position directly below the spray nozzles 34. At that time, the drive arrangement 56 begins operation and moves the drive arm 54 downwardly towards the cartons 10. Due to the fact that the drive arm 54 and the mounting plate 36 are urged towards one another by way of the tension spring 64 or other similar device, the downward movement of the drive arm 54 also causes the spray assemblies 31 and the shaft 40 to move downwardly. The downward movement of the spray assemblies 31 and the score line breaking assembly 50 will continue until the lowermost adjustable nut 44 contacts the fixed stopper 46 as illustrated in FIG. 3(*b*).

It can be readily understood, therefore, that by adjusting the position of the adjustable nuts 44 along the shaft 40, it is possible to adjust the extent to which the spray assemblies 31 move downwardly. For example, by moving the adjusting nuts 44 upwardly on the shaft 40, the spray assemblies 31 can be moved vertically downwardly to a greater extent than that illustrated in FIG. 3(*b*).

Once the lowermost adjustable nut 44 contacts the fixed stopper 46, further downward movement of the spray assemblies 31 is inhibited. Preferably, the adjusting nuts 44 are positioned along the length of the shaft 40 to ensure that when the lowermost nut 44 contacts the fixed stopper 46, the anvils 62 on the spray heads 32 are positioned in the interior of their respective cartons 10 adjacent to the score line 16 which extends circumferentially around the front wall 12, back wall 13 and side walls 14 of the cartons 10 as depicted in FIG. 3(*b*).

The sterilization and carton score line breaking system of the present invention is intended to be used in filling machines which fill cartons of different heights. Those machines typically include an adjustment mechanism associated with the conveyor that allows the conveyor to be adjusted vertically depending upon the height of the cartons being filled. The adjustment feature provided by the adjustable nuts 44 is not intended to take the place of that adjustable conveyor. Rather, it is preferred that the adjustable nuts 44 be employed to initially set the position of the spraying assemblies 31 so that when the spraying assemblies 31 are in the position illustrated in FIG. 3(*b*), the anvils 62 are located adjacent the circumferentially extending score line 16. Thereafter, when the machine is used to fill cartons of a different height, the vertical location of the conveyor 24 can be adjusted.

After the spraying assemblies 31 reach the stop position shown in FIG. 3(*b*), further operation of the drive arrangement 56 causes the drive arm 54 to continue moving downwardly in opposition to the force of the tension spring 64 or other similar device. As the drive arm 54 moves downwardly, the breaker member 52 comes into contact with the upper portion of the upstanding walls of the cartons 10. In particular, the contacting surfaces 80 contact the front and back walls 12, 13 of the carton 10 while the pinch bars 70, 72, 74, 76 contact the oppositely positioned side walls 14 of the carton 10. Preferably, the pinch bars 70, 72, 74 and 76 and the contacting surfaces 80 are designed such that the pinch bars 70, 72, 74, 76 contact the upper portion of the carton side walls 14 before the contacting surfaces 80 contact the front and back walls 12, 13 of the carton 10. In that way, the score lines 18, 18′ (see FIG. 1) on the upper portion of the carton side walls 14 are broken in such a manner that the upper portion of the carton side walls 14 are urged inwardly rather than outwardly.

Further downward movement of the drive arm 54 and the breaker member 52 causes the upper portion of the upstanding carton walls 12, 13, 14 to bend or fold inwardly, thereby breaking or further breaking the score lines 16, 18, 18′ and ensuring that the carton 10 will be properly closed and sealed at the closing and sealing station.

Proper breaking of the carton score line 16 that extends around the circumference of the upstanding carton walls 12, 13, 14 is further facilitated by the anvil 62 which is located at the score line 16. The anvil 62 tends to support the upstanding carton walls 12, 13, 14 to help ensure that as the upper portion of the upstanding carton walls 12, 13, 14 are urged inwardly by the pinch bars 70, 72, 74, 76 and the contacting surfaces 80, the upper portion of the carton walls bend or fold at the score line 16 rather than at some other point. The tapered upper surface of the anvil 62 itself helps ensure that the anvil 62 does not impede the inward folding of the upper portion of the carton walls 12, 13, 14.

FIGS. 6(*a*), 6(*b*) and 6(*c*) illustrate the way in which the contacting surfaces 80 engage the upstanding carton walls 12, 13 during downward movement of the breaker member 52. FIG. 6(*a*) depicts the position of the breaker member 52 just before the contacting surfaces 80 come into contact with the upper portion of the front and back walls 12, 13 of the carton. In FIG. 6(*b*), the breaker member 52 has moved further downwardly so as to begin urging the upper portion of the front and back walls of the carton inwardly towards one another. Finally, in FIG. 6(*c*), the breaker member 52 has reached its downwardmost position where the upper portion of the front and back walls 12, 13 of the carton 10 are fully received in the breaker member 52.

FIG. 4 also illustrates the breaker member 52 in its lowermost position in which the upper portion of the carton side walls 14 are urged inwardly to their greatest extent. The contoured surfaces of the pinch bars 70, 72, 74, 76 can be designed such that when the breaker member 52 is in its lowermost position, the inwardly pinched upper portion of the carton side walls 14 are in close proximity to, and possibly even in contact with, the outer surface of the spray head 32. To illustrate the extent of the inward folding of the carton walls 12, 13, 14, the spray head 32 can have an outer diameter of about 9 mm which means that the side walls 14 can be folded inwardly to such an extent that the inwardly pinched points of the oppositely positioned side walls 14 are spaced apart approximately 9 mm when the breaker member 52 is in its lowermost position (i.e., the position illustrated in FIG. 3(*c*)).

By the time the breaker member 52 reaches its lowermost position illustrated in FIG. 3(*c*), the score lines 16, 18, 18′ on the carton walls 12, 13, 14 have been well broken. Consequently, when the carton 10 is subsequently filled and advanced to the closing and sealing station, the upper portion of the carton 10 can be properly closed and sealed to result in a filled gable top carton.

A control device or other suitable arrangement can be incorporated into the system to control operation of the drive arrangement 56 so that when the breaker member 52 reaches the position illustrated in FIGS. 4 and 6(*c*), operation of the drive arrangement ceases. Thereafter, operation of the drive arrangement 56 is reversed and the breaker member 52 moves upwardly to the position illustrated in FIG. 3(*b*). While the breaker member 52 is moving upwardly to the position illustrated in FIG. 3(*b*), the spraying assemblies 31 remain stationary to help ensure that the carton 10 is not lifted off the conveyor 24. Once the breaker member 52 moves upwardly and clears the carton walls 12, 13, 14, the carton walls 12, 13, 14 are free to bend outwardly to a generally upright position so that the anvil 62 can be moved upwardly out of the carton 10 without lifting the carton 10 off the conveyor 24. If the breaker member 52 and the spray assemblies 31 were moved upward simultaneously, the breaker member 52 would inhibit the carton walls 12, 13, 14 from bending outwardly upon withdrawal of the anvil 62 from the carton interior.

In some instances, it may not be possible to completely prevent the cartons from being lifted off the conveyor. Thus, it may be desirable to include a device that prevents the cartons 10 from being lifted off the conveyor 24 to a significant extent. Such a device could take the form of a carton contacting member 71 (see FIG. 5) that is fixed to the machine frame (not shown) and that extends downwardly towards the position that the carton 10 assumes during the sterilizing and score line breaking operation. Preferably, a cutout portion 73 is formed in the breaker member 52 (see FIG. 5) so that the carton contacting member 71 can extend freely by the breaker member 52 and contact the top edge of the carton 10 should the carton 10 lift off the conveyor during upward movement of the sterilizing assembly and the score line breaking assembly.

Once the breaker member 52 reaches the position illustrated in FIG. 3(*b*), the drive arm 54 contacts the mounting plate 36 and continued operation of the driving arrangement 56 causes the breaker member 52 and the spray assemblies 31 to move upwardly simultaneously until they reach the position illustrated in FIG. 3(*a*). At that point, operation of the drive arrangement 56 ceases and the cartons 10 are advanced to the filling station 26 by the conveyor 24. As a result, two new unbroken and unsterilized cartons 10 are advanced in position under the spray nozzles 34 and the foregoing operation once again begins.

Preferably, sterilizing solution such as a hydrogen peroxide solution is continuously discharged through the spray nozzles 34. Thus, the spray assemblies 31 and the score line breaking assembly are preferably enclosed within a housing 82 (see FIG. 2).

By way of the above-described system, sterilization of the interior of the cartons and the breaking of the score lines on the cartons is performed simultaneously at the same station. As a result, significant space savings within the machine can be realized since it is not necessary to break the score lines at one station and then advance the cartons to another station to be sterilized. Further, existing machines which only possess a sterilizing station can be readily modified to include a score line breaking operation. That modification can be performed without the need for significant additional space in the machine.

Various types of known systems can be employed to supply sterilizing solution, such as a hydrogen peroxide solution, to the spraying assemblies 31. Alternatively, certain advantages can be realized by employing a gravity fed supply system, such as illustrated in FIG. 7. For purposes of simplicity, the score line breaking assembly 50 is not illustrated in FIG. 7.

The gravity fed supply system includes a reservoir 84 which contains a supply of a sterilizing solution, such as a hydrogen peroxide solution. The reservoir 84 can be appropriately sized to hold a desired amount of sterilizing solution. A fifteen liter reservoir 84 has been found to be useful. A pump 86 is connected to the reservoir 84 for pumping the sterilizing solution to an accumulator 88 that is provided with a vent 89. The accumulator 88 can also be of any desired size, although an accumulator 88 suitably dimensioned to hold 250 ml has been found useful. The sterilizing solution in the accumulator 88 is gravity fed to each of the spray assemblies 31 by way of flow meters/regulators 90 and flow monitors 92. The flow meters/regulators 90 allow the flow of sterilizing solution to the spray assemblies 31 to be regulated while the flow monitors 92 allow for monitoring of the flow in the event that flow problems (e.g., clogged spray nozzles) should arise. An air regulator 94 is also connected to the spraying assemblies 31 to regulate air flow into the spraying assemblies 31 in order to result in an atomized spray of sterilizing solution. A bypass valve 96 is interposed in a drain line 98 which allows the accumulator 88 to be drained when desired. Also, an overflow line 100 is disposed between the accumulator 88 and the reservoir 84. Preferably, sterilizing solution is continually pumped from the reservoir 24 to the accumulator 88 to ensure that the accumulator 88 is always full. In that way, a relatively constant head can be maintained so that flow through the spray assemblies 3 1 is substantially constant.

In the preferred embodiment, a 0.1% hydrogen peroxide solution is used. The flow rate can be approximately 0.3 liters/hr. for one-half pint cartons or approximately 1.0 liters/hr. for one liter cartons. Utilizing a hydrogen peroxide solution having the aforementioned concentration and employing flow rates similar to those mentioned above results in a pans per million range of hydrogen peroxide that falls within the acceptable limits established by the Food and Drug Administration. Consequently, it is not absolutely necessary to employ a drying station 30 (see FIG. 2) after the sterilizing and score line breaking station 28. In place of the drying station, however, it has been found useful to subject the cartons to ultraviolet light irradiation. The ultraviolet light irradiation interacts with the hydrogen peroxide solution to provide synergistic sterilizing results. As an alternative to the ultraviolet light, hot air could be employed.

While the present invention has been illustrated and described in accordance with the preferred embodiment, it is to be recognized that variations, changes and equivalence may be made therein without departing from the spirit of the invention as set forth in the claims.

What is claimed is:

1. Method of sterilizing and breaking score lines on a carton, comprising:

advancing to a sterilizing and score line breaking station a carton having a preformed bottom and upstanding walls that define an interior, and score lines on the upstanding walls;

spraying sterilizing solution into the interior of said carton while said carton is located at said sterilizing and score line breaking station; and urging upper portions of the upstanding walls of said carton inwardly to break at least some of the score lines on said carton while said carton is located at the same station as where sterilizing solution is sprayed into the interior of the carton so that the advancement of the carton between the spraying and urging steps is avoided.

2. Method according to claim 1, wherein the upper portions of the upstanding walls of said carton are urged inwardly by moving a breaker member in a downward direction from one position in which the breaker member is vertically spaced above said carton to another position in which the breaker member is in contact with the upper portion of the upstanding walls of said carton.

3. Method according to claim 1, wherein said step of spraying sterilizing solution includes moving a spray head provided with a spray nozzle in a downward direction from a first position in which the spray nozzle is positioned exteriorly of the interior of the carton to a second position in which the spray nozzle is positioned in the interior of the carton, the movement of the spray head in the downward direction being stopped when the spray head reaches the second position.

4. Method according to claim 3, wherein said spray head carries an anvil having an outer circumference that is greater than an outer circumference of the spray head, said anvil being positioned adjacent to one of the score lines extending circumferentially around the upstanding walls of the carton when the spray head reaches the second position to facilitate breaking of the score lines when the upstanding walls are urged inwardly.

5. Method according to claim 3, wherein said breaker member is moved from a first position to a second position simultaneously with movement of said spray head from said first position to said second position, said breaker member being vertically spaced above the carton in the first and second positions of the breaker member.

6. Method according to claim 1, wherein the steps of urging the upper portion of the upstanding wails of the carton inwardly and spraying the interior of said carton with sterilizing solution occur simultaneously.

7. Method of sterilizing and braking score lines on a carton, comprising:

advancing to a sterilizing and score line breaking station a carton having a preformed bottom and upstanding walls defining an interior, and score lines on the upstanding walls;

urging upper portions of the upstanding walls inwardly toward the interior of the carton to break at least some of the score lines on the carton; and spraying sterilizing solution into the interior of the carton during said step of urging the upstanding walls inwardly to break the score lines.

8. Method according to claim 7, wherein said score lines are broken by urging a breaker block into contacting engagement with the upstanding walls.

9. Method of sterilizing and breaking score lines on a carton, comprising:

advancing a carton to a station, said carton having a preformed bottom and upstanding wails to define an interior of the carton, and score lines on the upstanding walls;

inserting into the interior of the carton a spray nozzle;

spraying sterilizing solution through the spray nozzle and into the interior of the carton while the spray nozzle is located in the interior of the carton; and urging upper portions of the upstanding walls inwardly toward the interior of carton while the spray nozzle is located in the interior of the carton to break at least some of the score lines on the upstanding walls.

10. Method according to claim 9, wherein said step of spraying sterilizing solution is performed at least after the spray nozzle is positioned in the interior of the carton.

11. Method according to claim 10, wherein sterilizing solution is sprayed through the nozzle continuously.

12. Method according to claim 10, including an anvil positioned adjacent said spray nozzle which is inserted into the interior of the carton simultaneously with insertion of the spray nozzle into the interior of the carton, said anvil being inserted into the interior of the carton to a position adjacent one of the score lines on the upstanding walls to facilitate the breaking of the score lines when the upstanding walls are urged inwardly.

* * * * *